US005830843A

United States Patent [19]

Hartman et al.

[11] Patent Number: 5,830,843

[45] Date of Patent: Nov. 3, 1998

[54] FABRIC CARE COMPOSITIONS INCLUDING DISPERSIBLE POLYOLEFIN AND METHOD FOR USING SAME

[75] Inventors: Frederick Anthony Hartman, Cincinnati, Ohio; Bruno Albert Jean Hubesch, Tervuren; Axel Masschelein, Uccle, both of Belgium; John Robert Rusche, Cincinnati; John Cort Severns, West Chester, both of Ohio; John Christopher Turner, Overijse, Belgium

[73] Assignee: The Procter & Gamble Company, Cincinnati, Ohio

[21] Appl. No.: 594,546

[22] Filed: Jan. 31, 1996

[51] Int. Cl.[6] ..... C11D 3/37

[52] U.S. Cl. ..... 510/475; 510/522

[58] Field of Search ..... 510/515, 516, 510/517, 521, 522, 499, 501, 475

[56] References Cited

U.S. PATENT DOCUMENTS

| | | | |
|---|---|---|---|
| 3,475,207 | 10/1969 | Berch et al. | 117/143 |
| 3,565,840 | 2/1971 | Mirabile et al. | 260/23 |
| 3,574,520 | 4/1971 | Aldrich | 8/115.6 |
| 3,734,686 | 5/1973 | Douglas | 8/137 |
| 3,749,691 | 7/1973 | Kandathil | 260/29.6 |
| 3,822,145 | 7/1974 | Liebowitz et al. | 117/139.5 |
| 3,826,682 | 7/1974 | Liebowitz et al. | 117/139.5 |
| 3,984,335 | 10/1976 | Ciko et al. | 252/8.6 |
| 4,089,786 | 5/1978 | Ciko et al. | 252/8.8 |
| 4,211,815 | 7/1980 | Deiner | 428/290 |
| 4,252,656 | 2/1981 | Liebowitz et al. | 252/8.8 |
| 4,426,304 | 1/1984 | Ciko et al. | 252/8.75 |
| 4,474,668 | 10/1984 | Petzold et al. | 252/8.6 |
| 4,767,547 | 8/1988 | Straathof et al. | 252/8.8 |
| 4,975,091 | 12/1990 | Becker et al. | 8/115.66 |
| 5,019,281 | 5/1991 | Singer et al. | 252/8.8 |
| 5,047,065 | 9/1991 | Vogel et al. | 8/115.6 |
| 5,051,250 | 9/1991 | Patel et al. | 424/70 |
| 5,078,747 | 1/1992 | Kastele et al. | 8/181 |
| 5,185,088 | 2/1993 | Hartman et al. | 252/86 |
| 5,213,716 | 5/1993 | Patel et al. | 252/547 |
| 5,238,731 | 8/1993 | Blanch et al. | 428/266 |
| 5,310,783 | 5/1994 | Bernheim et al. | 524/837 |
| 5,346,642 | 9/1994 | Patel et al. | 252/174.21 |
| 5,474,690 | 12/1995 | Wahl et al. | 252/8.8 |
| 5,476,599 | 12/1995 | Rusche et al. | 252/88 |
| 5,500,138 | 3/1996 | Bacon et al. | 252/8.8 |
| 5,505,866 | 4/1996 | Bacon et al. | 252/8.6 |
| 5,531,910 | 7/1996 | Severns et al. | 510/102 |
| 5,536,421 | 7/1996 | Hartman et al. | 8/137 |
| 5,545,340 | 8/1996 | Wahl et al. | 510/517 |
| 5,545,350 | 8/1996 | Baker et al. | 510/517 |
| 5,559,088 | 9/1996 | Severns et al. | 510/102 |
| 5,562,847 | 10/1996 | Waite et al. | 510/519 |
| 5,562,849 | 10/1996 | Wahl et al. | 510/521 |
| 5,599,786 | 2/1997 | Siklosi et al. | 510/522 |

FOREIGN PATENT DOCUMENTS

| | | |
|---|---|---|
| 118611 | 9/1984 | European Pat. Off. . |
| 412 324 | 2/1991 | European Pat. Off. . |
| 535 437 | 4/1993 | European Pat. Off. . |
| 535 438 | 4/1993 | European Pat. Off. . |
| 234 687 | 4/1986 | Germany . |
| 3926-005 | 2/1991 | Germany . |
| 44 35 386 A | 4/1996 | Germany . |
| 1162898 | 8/1969 | United Kingdom . |
| 2 095 285 | 9/1992 | United Kingdom . |
| WO 91/19037 | 12/1991 | WIPO . |

*Primary Examiner*—Paul Lieberman
*Assistant Examiner*—John R. Hardee
*Attorney, Agent, or Firm*—R. S. Echler, Sr.; B. M. Bolam; K. W. Zerby

[57] ABSTRACT

The present invention relates to liquid, rinse added fabric softening compositions including a dispersible polyethylene and methods for their use. The fabric softeners of the present invention include a fabric softening compound or amine precursor thereof and a dispersible polyolefin. Preferably, the dispersible polyolefin is an emulsion and the polyolefin is polyethylene and, more preferably, a modified or oxidized polyethylene. A liquid carrier and optional dispersibility modifier are also included. The quaternary ammonium fabric softener is preferably cationic and biodegradable.

36 Claims, No Drawings

FABRIC CARE COMPOSITIONS INCLUDING DISPERSIBLE POLYOLEFIN AND METHOD FOR USING SAME

TECHNICAL FIELD

The present invention relates to rinse added, fabric care compositions and methods for using the same during the rinse cycle of a consumer laundry process. More particularly, the present invention relates to liquid, rinse added fabric softening compositions including dispersible polyolefin.

BACKGROUND OF THE INVENTION

In recent years, consumer desirability for durable press fabric garments, particularly cotton fabric garments, has risen. Durable press garments include those garments which resist wrinkling of the fabric both during wear and during the laundering process. Durable press garments can greatly decrease the hand work associated with laundering by eliminating ironing sometimes necessary to prevent wrinkling of the garment. However, in most commercially available durable press fabrics, the fabric's ability to resist wrinkling is reduced over time as the garment is repeatedly worn and laundered.

Consumer desirability for fabric softening compositions has also risen. Fabric softening compositions impart several desirable properties to treated garments including softness and static control. Fabric softness of laundered garments is typically achieved by delivering a quaternary ammonium compound to the surface of the fabric. However, due to the fatty character of many of the quaternary ammonium compounds commercially employed as fabric softening agents, the ability of fabrics treated with these agents to absorb water may decrease. This decrease in water absorbency can be undesirable for certain fabric articles such as terry towels where water absorbency is an important feature.

Furthermore, colored garments have a tendency to wear and show appearance losses. A portion of this color loss may be attributed to abrasion in the laundering process, particularly in automatic washing machines and automatic laundry dryers.

Accordingly, there is a need for a fabric care composition, and, in particular, a rinse added liquid fabric softening composition which can provide, refurbish or restore anti-wrinkle properties to fabrics, as well as provide static control, fabric softness, color appearance and fabric anti-wear properties and benefits. This need is met by the present invention wherein an improved liquid fabric softening composition is provided. The improved liquid fabric softening composition of the present invention includes a dispersible polyolefin. The inclusion of the dispersible polyolefin with quaternary ammonium fabric softening compounds can provide anti-wrinkling properties, water absorbency, static control, color appearance, fabric softness and fabric wear properties to garments which have been treated in the rinse cycle of a consumer laundering process with the composition.

BACKGROUND ART

U.S. Pat. No. 3,984,335 and 4,089,786 disclose souring and softening compositions for textile fabrics. U.S. Pat. No. 3,749,691 discloses detergent compatible fabric softening compositions. European Patent 118,611 discloses compositions for softening fibrous materials, particularly textile fabrics. U.S. Pat. No. 3,734,686 discloses compositions for treating carpet and pile fabrics. U.S. Pat. No. 3,822,145 discloses fabric softening foams which are sprayed into a tumble dryer. U.S. Pat. No. 5,019,281 discloses softhand agents for textile applications. Japanese Patent Application JP53035085 discloses aerosol sizing agents. Indian Patent Application 167973 A discloses a mixed catalyst system for producing durable press fabrics. European Patent 0 535 438 A1 discloses a polyethylene solution for treating textiles. U.S. Pat. No. 4,474,668 discloses smoothing agents for textile fibers. U.S. Pat. No. 4,252,656 discloses foam conditioners for fabrics. U.S. Pat. No. 3,574,520 discloses solutions for treating cellulosic garments. U.S. Pat. No. 5,019,281 discloses hydrophilic softhand agents for fibrous materials.

SUMMARY OF THE INVENTION

The present invention relates to liquid, rinse added fabric softening compositions which provide anti-wrinkle properties and improved water absorbency, color appearance, fabric wear and fabric softness properties. In accordance with a first aspect of the present invention, a liquid, rinse added fabric softening composition is provided. The composition comprises:

(A) from about 0.05% to about 50% by weight of the composition of a cationic quaternary ammonium fabric softening compound or amine precursor;

(B) from about 0.01% to about 50% by weight of the composition of a dispersible polyolefin;

(C) optionally, from about 0% to about 30% by weight of the composition of a dispersibility modifier; and (D) the balance comprising a liquid carrier selected from the group consisting of: water; $C_{1-4}$ monohydric alcohol; $C_{2-6}$ polyhydric alcohol; propylene carbonate; liquid polyethylene glycols; and mixtures thereof;

wherein the level of amphoteric surfactant, if any, is less than about 1% by weight of said composition.

The dispersible polyolefin is preferably added as an emulsion or suspension of polyolefin. The emulsion may comprise from about 10 to about 35% by weight of polyolefin, and an emulsifier. The ratio of emulsifier to polyolefin in the emulsion may be from about 1:10 to about 3:1. The polyolefin is preferably polyethylene, more preferably a modified polyethylene and most preferably an oxidized polyethylene. The emulsifier is preferably a cationic or nonionic surfactant. Preferred compositions include two classes of compositions—those having high quat/low polyolefin ratios and those which have low quat/high polyolefin ratios.

The quaternary ammonium compound or amine precursor preferably has the formula:

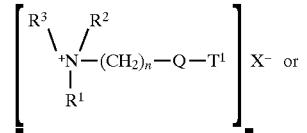

(I)

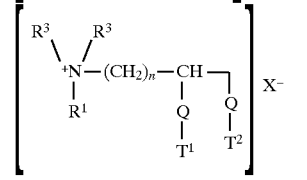

(II)

wherein each Q, n, R, T are selected independently and wherein Q is —O—C(O)— or —C(O)—O— or —O—C(O)—O— or —$NR^4$—C(O)— or —C(O)—$NR^4$—; $R^1$ is $(CH_2)_n$—Q—$T^2$ or $T^3$ or $R^3$; $R^2$ is $(CH_2)_m$—Q—$T^4$ or $T^5$ or $R^3$; $R^3$ is $C_1$–$C_4$ alkyl or $C_1$–$C_4$ hydroxyalkyl or H; $R^4$ is H or $C_1$–$C_4$ alkyl or $C_1$–$C_4$ hydroxyalkyl; $T^1$, $T^2$, $T^3$, $T^4$, $T^5$ are (the same or different) $C_{11}$–$C_{22}$ alkyl or alkenyl; n and m are integers from 1 to 4; and $X^-$ is a softener-compatible anion, the alkyl, or alkenyl, chain $T^1$, $T^2$, $T^3$, $T^4$, $T^5$ must contain at least 11 carbon atoms. More preferably, the quaternary ammonium compound is derived from $C_{12}$–$C_{22}$ fatty acyl groups having an Iodine Value of from greater than about 5 to less than about 100, a cis/trans isomer weight ratio of greater than about 30/70 when the Iodine Value is less than about 25, the level of unsaturation of the fatty acyl groups being less than about 65% by weight. Most preferably, the fabric softening compound is N,N-di(tallowyl-oxy-ethyl)-N,N-dimethyl ammonium chloride. The pH of the composition is preferably about 2 to about 7.

The composition may also include a dispersibility modifier selected from the group consisting of: single-long-chain-$C_{10}$–$C_{22}$ alkyl, cationic surfactant; nonionic surfactant with at least 8 ethoxy moieties; amine oxide surfactant; quaternary ammonium salts of the general formula:

$$(R^2N^+R_3)X^-$$

wherein the $R^2$ group is a $C_{10}$–$C_{22}$ hydrocarbon group, or the corresponding ester linkage interrupted group with a short alkylene ($C_1$–$C_4$) group between the ester linkage and the N, and having a similar hydrocarbon group, each R is a $C_1$–$C_4$ alkyl or substituted alkyl, or hydrogen; and the counterion $X^-$ is a softener compatible anion, and mixtures thereof In accordance with another aspect of the present invention, a liquid, rinse added fabric softening composition comprising:

(A) from about 0.05% to about 50% by weight of the composition of a cationic quaternary ammonium fabric softening compound or amine precursor thereof has the formula (I) or (II), below

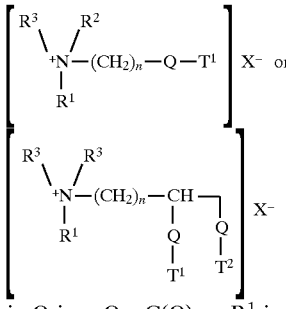

(I)

$X^-$ or (II)

wherein Q is —O—C(O)—, $R^1$ is $(CH_2)_n$—Q—$T^2$, $R^2$ and $R^3$ can be the same or different and is a $C_1$–$C_4$ alkyl or $C_1$–$C_4$ hydroxyalkyl or H; $T^1$ and $T^2$ are (the same or different) $C_{11}$–$C_{22}$ alkyl or alkenyl; n and m are integers from 1 to 4; and $X^-$ is a softener-compatible anion;

(B) from about 0.01% to about 50% by weight of the composition of a dispersible polyethylene;

(C) optionally, from about 0% to about 30% by weight of the composition of a dispersibility modifier; and (D) the balance comprising a liquid carrier selected from the group consisting of: water; $C_{1-4}$ monohydric alcohol; $C_{2-6}$ polyhydric alcohol; propylene carbonate; liquid polyethylene glycols; and mixtures thereof is provided.

Preferably, quaternary ammonium compound is derived from $C_{12}$–$C_{22}$ fatty acyl groups having an Iodine Value of from greater than about 5 to less than about 100, a cis/trans isomer weight ratio of greater than about 30/70 when the Iodine Value is less than about 25, the level of unsaturation of the fatty acyl groups being less than about 65% by weight. Most preferably, the fabric softening compound is N,N-di(tallowyl-oxy-ethyl)-N,N-dimethyl ammonium chloride.

The dispersible polyethylene is preferably added as an emulsion or suspension of polyethylene. The emulsion may comprise from about 10 to about 35% by weight of polyethylene, and an emulsifier. The ratio of emulsifier to polyethylene in the emulsion may be from about 1:10 to about 3:1. The polyethylene is preferably an oxidized polyethylene The emulsifier is preferably a cationic or nonionic surfactant. The pH of the composition preferably ranges from about 2 to about 5. Preferred compositions include two classes of compositions—those having high quat/low polyolefin ratios and those which have low quat/high polyolefin ratios. High quat/low polyolefin compositions include those where the total active defined as the sum of fabric softening compound or amine precursor thereof and dispersible polyolefin is within the range of from about 1% to about 40% by weight of the composition and the mass ratio of the softening compound to the polyolefin is within the range of from about 75:1 to about 5:1. Low quat/high polyolefin compositions include those when the total active defined as the sum of fabric softening compound or amine precursor thereof and dispersible polyolefin is within the range of from about 1% to about 40% by weight of the composition and the mass ratio of the softening compound to the polyolefin is within the range of from about 75:1 to about 5:1.

In accordance with yet another aspect of the present invention, a fabric softening composition is provided. The composition comprises:

(A) from about 4% to about 30% by weight of the composition of N,N-di(tallowyl-oxy-ethyl)-N,N-dimethyl ammonium chloride thereof;

(B) from about 0.5% to about 25% by weight of the composition of an cationic emulsion or suspension of oxidized polyethylene;

(C) optionally, from about 0% to about 30% by weight of the composition of a dispersibility modifier; and (D) the balance comprising a liquid carrier selected from the group consisting of: water; $C_{1-4}$ monohydric alcohol; $C_{2-6}$ polyhydric alcohol; propylene carbonate; liquid polyethylene glycols; and mixtures thereof.

In accordance with still another aspect of the present invention, a method for laundering fabrics is provided. The method comprises contacting the fabrics during the rinse cycle of a consumer laundry process with an aqueous medium containing at least 50 ppm of a laundry composition of a fabric softening compositions as described above.

Accordingly, it is an object of the present invention to provide a liquid rinse added fabric softening composition. It is another object of the present invention to provide a liquid rinse added fabric softening composition which includes a cationic quaternary ammonium fabric softening compound and a dispersible polyolefin. It is still another object of the present invention to provide a liquid, rinse added fabric softening composition which imparts anti-wrinkle properties and improved static control, water absorbency, fabric softness, color appearance and fabric anti-wear properties. These, and other, objects, features and advantages will be clear from the following detailed description and the appended claims.

All percentages, ratios and proportions herein are on a weight basis unless otherwise indicated. All documents cited herein are hereby incorporated by reference.

DETAILED DESCRIPTION OF THE PREFERRED EMBODIMENTS

I. Fabric Softening Compounds

The present invention relates to liquid, rinse added fabric softening compositions which improve various properties, such as wrinkle reduction, water absorbency, static control and color appearance of fabrics to which they are applied. The fabric softening compositions include a quaternary ammonium fabric softening compound or an amine precursor of the cationic quaternary ammonium fabric softening compound.

Cationic Quaternary Ammonium Compounds

The preferred quaternary ammonium compounds or amine precursors of the present invention are cationic biodegradable quaternary ammonium compounds having the formula (I) or (II), below:

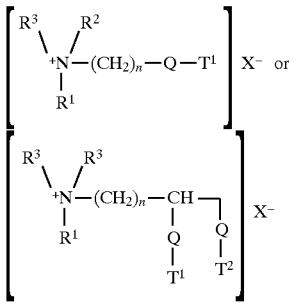

(I)

(II)

wherein Q, n, R and T are selected independently and

Q is —O—C(O)— or —C(O)—O— or —O—C(O)—O— or —$NR^4$—C(O)— or —C(O)—$NR^4$—;

$R^1$ is $(CH_2)_n$—Q—$T^2$ or $T^3$ or $R^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are (the same or different) $C_{11}$–$C_{22}$ alkyl or alkenyl; n and m are integers from 1 to 4; and $X^-$ is a softener-compatible anion, such as chloride, methyl sulfate, etc.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Q, n, $T^1$, and $T^2$ may be the same or different when more than one is present in the molecule.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Preferred quaternary ammonium compounds or amine precursors thereof include those of formula (I) or (II) wherein Q is —O—C(O)—, $R^1$ is $(CH_2)_n$—Q—$T^2$, $R^2$ and $R^3$ are the same or different and are $C_1$–$C_4$ alkyl or $C_1$–$C_4$ hydroxyalkyl or H; $T^1$ and $T^2$ are (the same or different) $C_{11}$–$C_{22}$ alkyl or alkenyl; n and m are integers from 1 to 4; and $X^-$ is a softener-compatible anion, such as chloride, methyl sulfate, etc.

Specific examples of quaternary ammonium compounds of formula (I) or (II) suitable for use in the aqueous fabric softening compositions herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl) ammonium chloride;
3) 1,2-ditallowyloxy-3-N,N,N-trimethylammoniopropane chloride.; and mixtures of any of the above materials.

Of these, compounds 1–2 are examples of compounds of Formula (I); compound 3 is a compound of Formula (II).

Particularly preferred is N,N-di(tallowoyl-oxy-ethyl)-N, N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than about 30/70, preferably greater than about 50/50 and more preferably greater than about 70/30 provides optimal concentrability.

For compounds of Formula (I) made from tallow fatty acids having a IV of above 25, the ratio of cis to trans isomers has been found to be less critical unless very high concentrations are needed.

At least 80% of the preferred diester quaternary ammonium compounds, i.e., DEQA of formula (I) and (II) is preferably in the diester form, and from 0% to about 20%, preferably less than about 15%, more preferably less than about 10%, can be monoester, i.e., DEQA monoester (e.g., containing only one —Q—$T^1$ group). As used herein, when the diester is specified, it will include the monoester that is normally present in manufacture. For softening, under no/low detergent carry-over laundry conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the softener compound.

Other examples of suitable quaternary ammonium compounds of Formula (I) and (II) are obtained by, e.g., replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, the amines being substantially protonated in the present compositions due to the claimed pH values.

Other formula (I) quaternary ammonium compounds useful as fabric softeners in the present invention include:

(i) diamido quaternary ammonium salts having the formula:

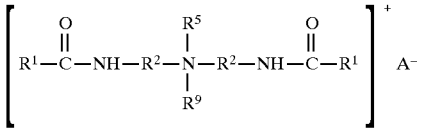

wherein $R^1$ is an acyclic aliphatic $C_{15}$–$C_{21}$ hydrocarbon group, each $R^2$ is the same or different divalent alkylene group having 1 to 3 carbon atoms, $R^5$ and $R^9$ are $C_1$–$C_4$ saturated alkyl or hydroxyalkyl groups, or $(CH_2CH_2O)_nH$ wherein n is equal to 1 to about 5 and $A^-$ is an anion;

(ii)

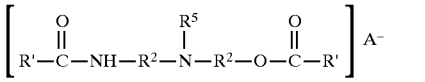

wherein $R^1$ is an acyclic aliphatic $C_{15}$–$C_{21}$ hydrocarbon group, $R^2$ is the same or different divalent alkylene group having 1 to 3 carbon atoms, $R^5$ are $C_1$–$C_4$ saturated alkyl or hydroxyalkyl groups, $A^-$ is an anion and $R^2$ is the same or different from the other $R^2$, and (iii) mixtures thereof Examples of compounds of (i) or (ii) as described above are the well-known and include methyl bis(tallowamidoethyl)(2-hydroxyethyl)ammonium methylsulfate and methyl bis(hydrogenated tallowamidoethyl)(2-hydroxyethyl)ammonium methylsulfate; these materials are available from Witco Chemical Company under the trade names Varisoft® 222 and Varisoft® 110, respectively: The quaternary ammonium or amine precursors compounds herein are present at levels of from about 0.05% to about 50% by weight of compositions herein, depending on the composition execution which can be dilute with a preferred level of active from about 5% to about 15% by weight, or concentrated, with a preferred level of active from about 15% to about 50%, most preferably about 15% to about 35% by weight, or from about 15% to about 50% for high quat/low polyolefin and 0.05% to about 15% for low quat/high polyolefin formulations which will be described in more detail herein.

For the preceding fabric softening agents, the pH of the compositions herein is an important parameter of the present invention. Indeed, it influences the stability of the quaternary ammonium or amine precursors compounds, especially in prolonged storage conditions. The pH, as defined in the present context, is measured in the neat compositions at 20° C. The pH of the present invention may range from about 2 to about 7. The pH of the composition will depend upon the stability of various ingredients including the quaternary ammonium fabric softening compound. The pH of these compositions herein can be regulated by the addition of a Bronsted acid.

Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Alternative Cationic Ammonium Compounds

Additional cationic fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. Nos.: 3,861,870, Edwards and Diehl; 4,308,151, Cambre; 3,886,075, Bernardino; 4,233,164, Davis; 4,401,578, Verbruggen; 3,974,076, Wiersema and Rieke; 4,237,016, Rudkin, Clint, and Young; and European Patent Application publication No. 472,178, by Yamamura et al., the disclosures of which are all herein incorporated by reference.

For example, additional cationic fabric softener agents useful herein may comprise one or two of the following fabric softening agents: (a) the reaction product of higher fatty acids with a polyamine selected from the group consisting of hydroxyalkylalkylenediamines and dialkylenetriamines and mixtures thereof(preferably from about 10% to about 80%); and/or (b) cationic nitrogenous salts containing long chain acyclic aliphatic $C_{15}$–$C_{22}$ hydrocarbon groups (preferably from about 3% to about 40%); with said (a) and (b) preferred percentages being by weight of the fabric softening agent component of the present invention compositions.

Following are the general descriptions of the preceding (a) and (b) softener ingredients (including certain specific examples which illustrate, but do not limit the present invention). Component (a): Softening agents (actives) of the present invention may be the reaction products of higher fatty acids with a polyamine selected from the group consisting of hydroxyalkylalkylenediamines and dialkylenetriamines and mixtures thereof. These reaction products are mixtures of several compounds in view of the multifunctional structure of the polyamines.

The preferred Component (a) is a nitrogenous compound selected from the group consisting of the reaction product mixtures or some selected components of the mixtures. More specifically, the preferred Component (a) is compounds selected from the group consisting of substituted imidazoline compounds having the formula:

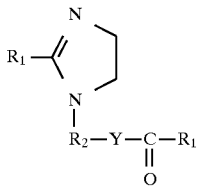

wherein $R^1$ is an acyclic aliphatic $C_{15}$–$C_{21}$ hydrocarbon group and $R^2$ is a divalent $C_1$–$C_3$ alkylene group, and Y is NH or O.

Component (a) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc., or Schercozoline® S by Scher Chemicals, Inc.; N,N"-ditallowalkoyldiethylenetriamine; 1-tallowamidoethyl-2-tallowimidazoline (wherein in the preceding structure $R^1$ is an aliphatic $C_{15}$–$C_{17}$ hydrocarbon group and $R^2$ is a divalent ethylene group).

Certain of the Components (a) can also be first dispersed in a Bronsted acid dispersing aid having a pKa value of not greater than about 4; provided that the pH of the final composition is not greater than about 5. Some preferred dispersing aids are hydrochloric acid, phosphoric acid, or methylsulfonic acid.

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl- 1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallow alkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

Component (b): The preferred Component (b) is a cationic nitrogenous salt, preferably selected from acyclic quaternary ammonium salts having the formula:

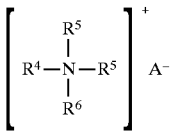

wherein $R^4$ is an acyclic aliphatic $C_{15}$–$C_{22}$ hydrocarbon group, $R^5$ is $R^4$ or $C_1$–$C_4$ saturated alkyl or hydroxy alkyl groups, and $R^6$ is $R^4$ or $R^5$ and A– is an anion.

Examples of Component (b) are the monoalkyltrimethylammonium salts such as monotallowtrimethylammonium chloride, mono(hydrogenatedtallow)trimethylammonium chloride, palmityltrimethyl ammonium chloride and soyatrimethylammonium chloride, sold by Witco Chemical Company under the trade name Adogen® 471, Adogen® 441, Adogen® 444, and Adogen® 415, respectively. In these salts, $R^4$ is an acyclic aliphatic $C_{16}$–$C_{18}$ hydrocarbon group, and $R^5$ and $R^6$ are methyl groups. Mono(hydrogenated tallow)trimethylammonium chloride and monotallowtrimethylammonium chloride are preferred. Further examples include dialkyl dimethylammonium salts such as ditallowdimethyl ammonium chloride. Examples of commercially available dialkyldimethyl ammonium salts usable in the present invention are di(hydrogenated tallow) dimethylammonium chloride (tradename Adogen® 442), ditallowdimethyl ammonium chloride (trade name Adogen® 470), distearyl dimethylammonium chloride (trade name Arosurf® TA-100), all available from Witco Chemical Company, dimethylstearylbenzyl ammonium chloride sold under the trade names Varisoft® SDC by Witco Chemical Company and Ammonyx® 490 by Onyx Chemical Company. Also preferred are those selected from the group consisting of di(hydrogenated tallow) dimethylammonium chloride, ditallowdimethylammonium chloride. Mixtures of the above examples are also included within the scope of the present invention.

A preferred compound of Component (a) include the reaction product of about 2 moles of hydrogenated tallow fatty acids with about 1 mole of N-2-hydroxyethylethylenediamine or diethylene triamine and is present at a level of from about 20% to about 70% by weight of the fabric softening component of the present invention compositions while preferred compounds of component (b) include mono(hydrogenated tallow)trimethyl ammonium chloride and di(hydrogenated tallow)dimethyl ammonium chloride present at a level of from about 3% to about 30% by weight of the fabric softening component of the present invention compositions; 1-tallowamidoethyl-2-tallowimidazoline, and mixtures thereof, wherein mixtures of compounds of (a) and (b) are present at a level of from about 20% to about 60% by weight of the fabric softening component of the present invention compositions; and wherein the weight ratio of said di(hydrogenated tallow) dimethylammonium chloride to said 1-tallowamidoethyl-2-tallowimidazoline is from about 1:2 to about 6:1.

In the cationic nitrogenous salts described herein before, the anion A– provides charge neutrality. Most often, the anion used to provide charge neutrality in these salts is a halide, such as chloride or bromide. However, other anions can be used, such as methylsulfate, ethylsulfate, hydroxide, acetate, formate, citrate, sulfate, carbonate, and the like. Chloride and methylsulfate are preferred herein as anion A–.

Nonionic Softening Compounds

Softening agents also useful in the compositions of the present invention are nonionic fabric softener materials, preferably in combination with cationic softening agents. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

The level of optional nonionic softener in the compositions herein is typically from about 0% to about 10%, preferably from about 1% to about 5% by weight of the composition.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid, oleic and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono-and/or diesters of the polyglycerol polyols are preferred, the fatty acyl groups typically being those described herein before for the sorbitan and glycerol esters.

In addition, since the foregoing compounds (diesters) are somewhat labile to hydrolysis, they should be handled rather carefully when used to formulate the compositions herein. For example, stable liquid compositions herein are formulated at a pH (neat) in the range of from about 2 to about 7, preferably from about 2 to about 5, more preferably from about 2 to about 4.5. For best product odor stability, when the IV is greater that about 25, the neat pH is from about 2.8 to about 3.5, especially for lightly scented products. This appears to be true for all of the above softener compounds and is especially true for the preferred DEQA specified herein, i.e., having an IV of greater than about 20, preferably greater than about 40. The limitation is more important as IV increases. The pH can be adjusted by the addition of a Bronsted acid as described above. pH ranges for making chemically stable softener compositions containing diester quaternary ammonium fabric softening compounds are disclosed in U.S. Pat. No. 4,767,547, Straathof et al., issued on Aug. 30, 1988, which is incorporated herein by reference.

Liquid compositions of this invention typically contain from about 0.05% to about 50%, preferably from about 2% to about 40%, more preferably from about 4% to about 32%, of quaternary ammonium softener active. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

II. Polyolefin

The liquid, rinse added fabric softening compositions of the present invention also includes a dispersible polyolefin. Preferably, the polyolefin is a polyethylene, polypropylene or mixtures thereof. The polyolefin may be at least partially modified to contain various functional groups, such as carboxyl, alkylamide, sulfonic acid or amide groups. More preferably, the polyolefin employed in the present invention is at least partially carboxyl modified or, in other words, oxidized. In particular, oxidized or carboxyl modified polyethylene is preferred in the compositions of the present invention.

For ease of formulation, the dispersible polyolefin is preferably introduced as a suspension or an emulsion of polyolefin dispersed by use of an emulsifying agent. The polyolefin suspension or emulsion preferably has from about 1 to about 50%, more preferably from about 10 to about 35% by weight, and most preferably from about 15 to about 30% by weight of polyolefin in the emulsion. The polyolefin preferably has a molecular weight of from about 1,000 to about 15,000 and more preferably from about 4,000 to about 10,000.

When an emulsion is employed, the emulsifier may be any suitable emulsification agent. Preferably, the emulsifier is a cationic or nonionic surfactant or mixtures thereof. Most any suitable cationic or nonionic surfactant may be employed as the emulsifier of the present invention. Preferred emulsifiers of the present invention are cationic surfactants such as the fatty amine surfactants and in particular the ethoxylated fatty amine surfactants. In particular, the cationic surfactants are preferred as emulsifiers in the present invention when the pH of the liquid fabric softener composition is formulated in the preferred range of from about 2 to about 7. The dispersible polyolefin is dispersed by use of an emulsifier or suspending agent in a ratio of emulsifier to polyolefin of from about 1:10 to about 3:1. Preferably, the emulsion includes from about 0.1 to about 50%, more preferably from about 1 to about 20% and most preferably from about 2.5 to about 10% by weight of emulsifier in the polyolefin emulsion. Polyethylene emulsions suitable for use in the present invention are available under the tradename VELUSTROL from HOECHST Aktiengesellschaft of Frankfurt am Main, Germany. In particular, the polyethylene emulsions sold under the tradename VELUSTROL PKS, VELUSTROL KPA and VELUSTROL P-40 may be employed in the compositions of the present invention.

The compositions of the present invention may contain from about 0.01% to about 50% by weight of the polyolefin. More preferably, the compositions include from about 0.5% to about 20% by weight polyolefin and most preferably from about 0.5% to about 10% by weight polyolefin. When the dispersible polyolefin is added as an emulsion or suspension of polyolefin as described above, from about 0.1% to about 90%, and more preferably from about 0.5% to about 25% by weight of the emulsion or suspension may be added.

Particularly preferred compositions according to the present invention include both those of high quat/low polyolefin and low quat/high polyolefin concentrations. By the phrase high quat/low polyolefin, it is intended to encompass a composition having a mass ratio of quaternary ammonium fabric softening compound to dispersible polyolefin in the range of from about 100:1 to about 3:1, preferably 75:1 to about 5:1 and more preferably from about 50:1 to about 10:1 where the total active defined as the sum of quaternary amine softener and dispersible polyolefin is from about 1% to about 40% by weight of the composition. By the phrase low quat/high polyolefin, it is intended to encompass a composition having mass ratio of quaternary ammonium fabric softening compound to dispersible polyolefin in the range of from about 0.01:1 to about 3:1, preferably from about 0.05:1 to about 2:1 and more preferably from about 0.1:1 to about 1:1 where the total active defined as the sum of quaternary amine softener and dispersible polyolefin is from about 1% to about 40% by weight of the composition.

III. Carrier Ingredients

The liquid carrier employed in the instant compositions is preferably water due to its low cost, relative availability, safety, and environmental compatibility. The level of water in the liquid carrier is generally more than about 50%, preferably more than about 80%, more preferably more than about 85%, by weight of the carrier. The level of liquid carrier is generally greater than about 50%, preferably greater than about 65%, more preferably greater than about 70% of the instant composition. Mixtures of water and low molecular weight, e.g., <about 100, organic solvent, e.g., lower alcohol such as ethanol, propanol, isopropanol or butanol; propylene carbonate; and/or glycol ethers, are useful as the carrier liquid. Low molecular weight alcohols include monohydric such as $C_{1-4}$ monohydric alcohols, dihydric (glycol, etc.) trihydric (glycerol, etc.), and polyhydric (polyols) alcohols, such as $C_{2-6}$ polyhydric alcohols.

IV. Additional Ingredients

Fully formulated fabric softening compositions may contain, in addition to the herein before described components, one or more of the following ingredients.

Concentrated compositions of the present invention may require organic and/or inorganic concentration aids to go to even higher concentrations and/or to meet higher stability standards depending on the other ingredients. Surfactant concentration aids are typically selected from the group consisting of single long chain alkyl cationic surfactants; nonionic surfactants; amine oxides; fatty acids; or mixtures thereof, typically used at a level of from 0 to about 15% of the composition.

In addition, the compositions of the present invention may include less than about 1% by weight of an amphoteric surfactant. Preferably, the compositions include less than about 0.9% and more preferably less than about 0.75% by weight of an amphoteric surfactant.

V. Dispersibility Modifiers

Viscosity/dispersibility modifiers can be added for the purpose of facilitating the solubilization and/or dispersion, concentration, and/or improving phase stability (e.g., viscosity stability). Some preferred dispersibility modifiers may include:

(1) Single-Long-Chain Alkyl Cationic Surfactant

The mono-long-chain-alkyl (water-soluble) cationic surfactants in liquid compositions are at a level of from 0% to about 30%, preferably from about 0.5% to about 10%, the total single-long-chain cationic surfactant present being at least at an effective level.

Such mono-long-chain-alkyl cationic surfactants useful in the present invention are, preferably, quaternary ammonium salts of the general formula:

$$(R^2N^+R_3)X^-$$

wherein the $R^2$ group is a $C_{10}$–$C_{22}$ hydrocarbon group, preferably $C_{12}$–$C_{18}$ alkyl group or the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester; each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

The ranges above represent the amount of the single-long-chain-alkyl cationic surfactant which is preferably added to the composition of the present invention. The ranges do not include the amount of monoester which is already present in component (A), the diester quaternary ammonium compound, the total present being at least at an effective level.

The long chain group $R^2$, of the single-long-chain-alkyl cationic surfactant, typically contains an alkyl, or alkylene group having from about 10 to about 22 carbon atoms, preferably from about 12 to about 16 carbon atoms for solid compositions, and preferably from about 12 to about 18 carbon atoms for liquid compositions. This $R^2$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

It will be understood that the main function of the water-soluble cationic surfactant is to lower the composition's viscosity and/or increase the dispersibility of the diester softener compound and it is not, therefore, essential that the cationic surfactant itself have substantial softening properties, although this can be the case. Also, surfactants having only a single long alkyl chain, presumably because they have greater solubility in water, can protect the diester softener from interacting with anionic surfactants and/or detergent builders that are carried over into the rinse.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts useful in the present invention have the general formula:

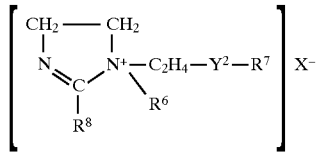

wherein $Y^2$ is —C(O)—O—, —O—(O)—C—, —C(O)—N($R^5$), or —N($R^5$)—C(O)— in which $R^5$ is hydrogen or a $C_1$–$C_4$ alkyl radical; $R^6$ is a $C_1$–$C_4$ alkyl radical; $R^7$ and $R^8$ are each independently selected from R and $R^2$ as defined herein before for the single-long-chain cationic surfactant with only one being $R^2$.

Some alkyl pyridinium salts useful in the present invention have the general formula:

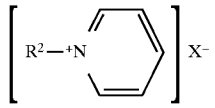

wherein $R^2$ and $X^-$ are as defined above. A typical material of this type is cetyl pyridinium chloride.

Amine oxides can also be used. Suitable amine oxides include those with one alkyl, or hydroxyalkyl, moiety of about 8 to about 22 carbon atoms, preferably from about 10 to about 18 carbon atoms, more preferably from about 12 to about 14 carbon atoms, and two alkyl moieties selected from the group consisting of alkyl groups and hydroxyalkyl groups containing from one to about three carbon atoms.

Examples of amine oxides include: dimethyloctylamine oxide; diethyldecylamine oxide; dimethyldodecylamine oxide; dipropyltetradecylamine oxide; dimethyl-2-hydroxyoctadecylamine oxide; dimethylcoconutalkylamine oxide; and bis-(2-hydroxyethyl)dodecylamine oxide.

(2) Nonionic Surfactant (Alkoxylated Materials)

Suitable nonionic surfactants to serve as the viscosity/dispersibility modifier include addition products of ethylene oxide and, optionally, propylene oxide, with fatty alcohols, fatty acids, fatty amines, etc. They are referred to herein as ethoxylated fatty alcohols, ethoxylated fatty acids, and ethoxylated fatty amines.

Any of the alkoxylated materials of the particular type described hereinafter can be used as the nonionic surfactant. In general terms, the nonionic herein, when used alone, are at a level of from 0% to about 5%, preferably from about 0.1% to about 5%, more preferably from about 0.2% to about 3%. Suitable compounds are substantially water-soluble surfactants of the general formula:

$$R^2—Y—(C_2H_4O)_z—C_2H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length is from about 16 to about 18 carbon atoms. In the general formula for the ethoxylated nonionic surfactants herein, Y is typically —O—, —C(O)O—, —C(O)N(R)—, or —C(O)N(R)R—, preferably —O—, and in which $R^2$, and R, when present, have the meanings given herein before, and/or R can be hydrogen, and z is at least about 8, preferably at least about 10∝11. Performance and, usually, stability of the softener composition decrease when fewer ethoxylate groups are present.

The nonionic surfactants herein are characterized by an HLB (hydrophilic-lipophilic balance) of from about 7 to about 20, preferably from about 8 to about 15. Of course, by defining $R^2$ and the number of ethoxylate groups, the HLB of the surfactant is, in general, determined. However, it is to be noted that the nonionic ethoxylated surfactants useful herein, for concentrated liquid compositions, contain relatively long chain $R^2$ groups and are relatively highly ethoxylated. While shorter alkyl chain surfactants having short ethoxylated groups can possess the requisite HLB, they are not as effective herein.

Nonionic surfactants as the viscosity/dispersibility modifiers are preferred over the other modifiers disclosed herein for compositions with higher levels of perfume.

Examples of nonionic surfactants follow. The nonionic surfactants of this invention are not limited to these examples. In the examples, the integer defines the number of ethoxy (EO) groups in the molecule.

(3) Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are n-$C_{18}$EO(10); and n-$C_{10}$EO(11). The ethoxylates of mixed natural or synthetic alcohols in the "tallow" chain length range are also useful herein. Specific examples of such materials include tallow alcohol-EO(11), tallow alcohol-EO (18), and tallow alcohol -EO(25).

(4) Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and HLB within the range recited herein are useful viscosity/dispersibility modifiers in the context of this invention. Exemplary ethoxylated secondary alcohols useful herein as the viscosity/dispersibility modifiers of the compositions are: 2-$C_{16}$EO(11); 2-$C_{20}$EO(11); and 2-$C_{16}$EO(14).

(5) Alkyl Phenol Alkoxylates

As in the case of the alcohol alkoxylates, the hexa- through octadeca-ethoxylates of alkylated phenols, particularly monohydric alkylphenols, having an HLB within the range recited herein are useful as the viscosity/dispersibility modifiers of the instant compositions. The hexa- through octadeca-ethoxylates of p-tridecylphenol, m-pentadecylphenol, and the like, are useful herein. Exemplary ethoxylated alkylphenols useful as the viscosity/dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

(6) Olefinic Alkoxylates

The alkenyl alcohols, both primary and secondary, and alkenyl phenols corresponding to those disclosed immediately hereinabove can be ethoxylated to an HLB within the range recited herein and used as the viscosity/dispersibility modifiers of the instant compositions.

(7) Branched Chain Alkoxylates

Branched chain primary and secondary alcohols which are available from the well-known "OXO" process can be ethoxylated and employed as the viscosity/dispersibility modifiers of compositions herein.

The above ethoxylated nonionic surfactants are useful in the present compositions alone or in combination, and the term "nonionic surfactant" encompasses mixed nonionic surface active agents.

(8) Mixtures

The term "mixture" includes the nonionic surfactant and the single-long-chain-alkyl cationic surfactant added to the composition in addition to any monoester present in the DEQA.

Mixtures of the above viscosity/dispersibility modifiers are highly desirable. The single long chain cationic surfactant provides improved dispersibility and protection for the primary DEQA against anionic surfactants and/or detergent builders that are carried over from the wash solution. The viscosity/dispersibility modifiers are present at a level of from about 0.1% to about 30%, preferably from about 0.2% to about 20%, by weight of the composition.

VI. Stabilizers

Stabilizers can be present in the compositions of the present invention. The term "stabilizer," as used herein, includes antioxidants and reductive agents both of which are well-known in the art. These agents are present at a level of from 0% to about 2%, preferably from about 0.01% to about 0.2%, more preferably from about 0.035% to about 0.1% by weight of the composition for antioxidants, and more preferably from about 0.01% to about 0.2% by weight of the composition for reductive agents. These assure good odor stability under long term storage conditions for the compositions and compounds stored in molten form. The use of antioxidants and reductive agent stabilizers is especially desirable for low scent products (low perfume).

VI. Soil Release Agents

Optionally, the compositions of the present invention may contain from 0% to about 10%, preferably from about 0.1% to about 5%, more preferably from about 0.1% to about 2% by weight of the composition of a soil release agent. Preferably, such a soil release agent is a polymer. Polymeric soil release agents useful in the present invention include copolymeric blocks of terephthalate and polyethylene oxide or polypropylene oxide, and the like. These agents give additional stability to the concentrated aqueous, liquid compositions. Therefore, their presence in such liquid compositions, even at levels which do not provide soil release benefits, is preferred.

Preferred soil release agents include a copolymer having blocks of terephthalate and polyethylene oxide, crystallizable polyesters and polymers of the generic formula:

$$X—(OCH_2CH_2)_n—(O—C(O)—R^1—C(O)—O—R^2)_u—(O—C(O)—R^1—C(O)—O)—(CH_2CH_2O)_n—X$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof $R^2$ may be any suitable ethylene or substituted ethylene moieties. A more complete disclosure of these highly preferred soil release agents is contained in European Patent Application 185,427, Gosselink, published Jun. 25, 1986, the disclosure of which is incorporated herein by reference.

VIII Cellulase

An optional cellulase may be used in the compositions herein. The cellulase can be any bacterial or fungal cellulase. Suitable cellulase is disclosed, for example, in GB-A-2 075 028, GB-A-2 095 275 and DE-OS-24 47 832, all incorporated herein by reference in their entirety.

Examples of such cellulase are cellulase produced by a strain of *Humicola insolens* (*Humicola grisea* var. thermoidea), particularly by the Humicola strain DSM 1800, and cellulase 212-producing fungus belonging to the genus Aeromonas, and cellulase extracted from the hepatopancreas of a marine mullosc (Dolabella Auricula Solander).

The cellulase added to the composition of the invention can be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium.

Preferred cellulase for use herein are characterized in that they provide at least 10% removal of immobilized radioactive labeled carboxymethyl-cellulose according to the $C_1^4$CMC-method described in EPA 350,098 (incorporated herein by reference in its entirety) at $25\times10^{-6}$% by weight of cellulase protein in the laundry test solution.

The most preferred cellulase is that described in International Patent Application WO 91/17243, incorporated herein by reference in its entirety. For example, a cellulase preparation useful in the compositions of the invention can consist essentially of a homogeneous endoglucanase component, which is immunoreactive with an antibody raised against a highly purified 43 kD cellulase derived from *Humicola insolens*, DSM 1800, or which is homologous to said 43 kD endoglucanase.

The cellulase herein should be used in the liquid fabric-conditioning compositions of the present invention at a level equivalent to an activity from about 1 to about 125 CEVU/gram of composition (CEVU=Cellulase Equivalent Viscosity Unit, as described, for example, in WO 91/13136, incorporated herein by reference in its entirety), and preferably an activity of from about 5 to about 100.

IX. Chelating Agent

The compositions herein employ one or more transition metal ion chelates (Fe, Ni and Cu)("chelators"). Such water-soluble chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove metal ions such as iron, copper, nickel, manganese and the like from rinse solutions by formation of soluble chelates. These chelating agents also appear to interact with dyes and optical brighteners on fabrics which have already been undesirably affected by interactions with copper or nickel cations in the laundry process, with the attendant color change and/or drabness effects. By the present invention, the whiteness and/or brightness of such affected fabrics are substantially improved or restored.

Amino carboxylates useful as chelating agents herein include ethylenediaminetetraacetates (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DTPA), and ethanoldiglycines, including their water-soluble salts such as the alkali metal, ammonium, and substituted ammonium salts thereof and mixtures thereof Amino phosphonates are also suitable for use as chelating agents in the compositions of the invention when at least low levels of total phosphorus are permitted in detergent compositions, and include ethylenediaminetetrakis (methylenephosphonates), diethylenetriamine-N,N,N',N", N"-pentakis(methane phosphonate) (DETMP) and 1-hydroxyethane-1,1-diphosphonate (HEDP). Preferably, these amino phosphonates to not contain alkyl or alkenyl groups with more than about 6 carbon atoms.

The chelating agents are typically used in the present rinse process at levels from about 2 ppm to about 50 ppm, for periods from 1 minute up to several hours' soaking.

The preferred EDDS chelator used herein (also known as ethylenediamine-N,N'-disuccinate) is the material described in U.S. Pat. No. 4,704,233, cited hereinabove, and has the formula (shown in free acid form):

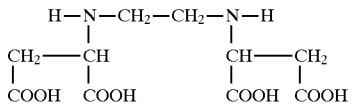

As disclosed in the patent, EDDS can be prepared using maleic anhydride and ethylenediamine. The preferred biodegradable [S,S] isomer of EDDS can be prepared by reacting L-aspartic acid with 1,2-dibromoethane. The EDDS has advantages over other chelators in that it is effective for chelating both copper and nickel cations, is available in a biodegradable form, and does not contain phosphorus. The EDDS employed herein as a chelator is typically in its salt form, i.e., wherein one or more of the four acidic hydrogens are replaced by a water-soluble cation M, such as sodium, potassium, ammonium, triethanolammonium, and the like. As noted before, the EDDS chelator is also typically used in the present rinse process at levels from about 2 ppm to about 25 ppm for periods from 1 minute up to several hours' soaking. As noted hereinafter, at certain pH's the EDDS is preferably used in combination with zinc cations.

As can be seen from the foregoing, a wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 99%, more preferably from about 0.1% to about 15%, and most preferably from about 0.1% to about 10%, by weight of the compositions herein. Preferred chelators include DETMP, DTPA, NTA, EDDS and mixtures thereof.

X. Other Ingredients

Other preferred optional ingredients include, but are not limited to, dye transfer inhibiting agents, polymeric dispersing agents, suds suppressors, optical brighteners or other brightening or whitening agents, dye fixing agents, light fading protection agents, oxygen bleach protection agents, fabric softening clay, anti-static agents, other active ingredients, carriers, hydrotropes, processing aids, dyes or pigments, bacteriocides, colorants, perfumes, preservatives, opacifiers, anti-shrinkage agents, anti-wrinkle agents, fabric crisping agents, spotting agents, germicides, fungicides, anti-corrosion agents, and the like.

The compositions of the present invention can provide numerous benefits to laundered garments or fabrics as opposed to prior art compositions. Theses benefits include fabric softness, increased water absorbency, static control, improved color appearance and anti-wear reduction. While not wishing to be bound by theory, through the use of the dispersible polyolefin and, in particularly, the dispersible polyethylene, the benefits of anti-wrinkling, water absorbency and improved color appearance and to a small extent fabric softness are provided. Meanwhile, through the use of the quaternary ammonium compound of the present invention the main fabric softening and static control benefits are provided. The benefits of water absorbency are most pronounced with the use of the low quat/high polyolefin compositions as described above. Through the use of higher levels of polyolefin, the decrease in water absorbency due to the fatty nature of the quaternary ammonium fabric softening compound may be offset and water absorbency of treated fabrics improved.

Most importantly, the compositions of the present invention may also provide wrinkle reduction properties to garments or fabrics. Through use of the compositions of the present invention, wrinkle reduction properties can be provided to garments which have not been previously treated with a wrinkle reducing agent. In addition, the compositions of the present invention may restore or refurbish the wrinkle reduction properties to garments or fabrics which have previously been treated with a wrinkle reducing agent or, in other words, durable press garments. Fabrics, especially cotton, have a tendency to wrinkle during the laundering process. Wrinkling is caused at the fiber level by the inability of the fibers to readily slip past one another in response to stresses applied to the fabric during laundering. The fibers can become "stuck" in the wrong configuration, thus leading to a wrinkle on the macroscopic level.

While not wishing to be bound by theory, it is believed that the polyolefin in the composition described herein serves as a lubricant between fibers, allowing them to slip past one another more easily. Thus, during laundering, the fabrics have a decreased propensity to wrinkle. To the consumer, the end result is garments which are less wrinkled at the end of the laundering event. Therefore, less ironing is required for the consumer to achieve the desired end result. In fact, some items of clothing may no longer need to be ironed as a result of treatment with the compositions herein. For those treated items that are still ironed, less time is required and the task is made easier due to the lubrication properties of the polyolefin.

While this benefit is shown for both the high quat/low polyolefin and low quat/high polyolefin composition described above, the preferred compositions for anti-wrinkling benefits are the high quat/low polyolefin compositions. The use of the quaternary ammonium compound will provide to a small extent an anti-wrinkle property. However, it is the inclusion of the dispersible polyolefin which provides the primary anti-wrinkling effect.

The compositions of the present invention provide a color appearance benefit. That is, the compositions of the present invention can improve the overall appearance of fabrics which are treated in the compositions of the present invention. This improved color appearance can be manifested in simple overall appearance of the fabrics or in the reduction of pilling. Colored fabrics have a tendency to lose color and become duller in appearance as a result of multiple launderings. One mechanism by which fabrics lose color is abrasion. Fabrics moving past one another and against the washing machine tub during laundering tend to "rough-up" their surfaces, resulting in microfibrils appearing on the surface of the fibers in the garment. Macroscopically, this appears as "fuzzing" or "dulling" of the color of the item. Furthermore, fabrics may begin to fray (wear), especially around seams, by a similar mechanism as a result of repeated launderings.

While not wishing to bound by theory, the use of lubricants such a polyolefins dispersed in a laundry composition, decreases the frictional forces encountered by the fabrics during the laundering process, thereby decreasing the fuzzing and fraying of the fibers. To the consumer, treated garments have colors more true to their original condition and appear less "worn-out" after multiple washings. The benefit of color appearance improvement is present in both the high quat/low polyolefin and low quat/high polyolefin composition described above.

Accordingly, the present invention also comprises a method for laundering fabrics or garments by contacting the fabrics or garments with the compositions of the present invention. Most preferably, the method includes contacting the fabrics or garments with the compositions during the rinse portion of a laundering process comprising both washing and rinsing steps. Thus, the method is also capable of providing a fabric or garment with wrinkle reduction, water absorbency, color appearance and fabric wear properties. The compositions can be added directly in the rinse both to provide adequate usage concentration, e.g., at least about 50 ppm and more preferably of from about 100 to about 10,000 ppm of the liquid rinse added fabric softeners of the present invention.

The following examples illustrate the compositions of this invention, but are not intended to be limiting thereof.

EXAMPLE I

Liquid fabric softening compositions according to the present invention are formulated as follows:

| Ingredient | A Wt. % | B Wt. % | C Wt. % | D Wt. % | E Wt. % | F Wt. % |
|---|---|---|---|---|---|---|
| Fabric Softening Compound(1) | 24.0 | — | 25.0 | — | — | — |
| Fabric Softening Compound(2) | — | 19.2 | — | — | — | — |
| Fabric Softening Compound(3) | — | — | — | 18.0 | — | — |
| Fabric Softening Compound(4) | — | — | — | — | 11.0 | 4.0 |
| Fabric Softening Compound(5) | — | — | — | — | 13.5 | — |
| Fabric Softening Compound(6) | — | — | — | — | — | 3.4 |
| Ethanol | 4.0 | — | 4.0 | — | 5.0 | 1.0 |
| Isopropanol | — | 3.0 | — | 6.0 | — | — |
| VELUSTROL PKS(7) | 3.0 | 3.0 | — | — | — | — |
| VELUSTROL KPA(8) | — | — | 3.0 | 3.0 | — | — |
| VELUSTROL P-40(9) | — | — | — | — | 3.0 | 3.0 |
| Calcium Chloride | 2.0 | 0.2 | 0.6 | 0.5 | 0.5 | 0.05 |
| Chelant(10) | 2.5 | — | — | — | — | — |
| Hydrochloric acid | 0.75 | 0.06 | 0.05 | 0.02 | — | 0.2 |
| Soil Release Agent(11) | 0.5–1 | 0.2 | 0.5 | — | — | — |
| Silicone Anti-foam | 0.01 | 0.01 | 0.01 | — | — | 0.01 |
| Misc. | 1.4 | 0.7 | 1.3 | 1.0 | 1.0 | 0.4 |
| Water | to 100 | to 100 | to 100 | to 100 | to 100 | to 100 |

(1)N,N-di(tallowyl-oxy-ethyl)-N,N-dimethyl ammonium chloride (IV 50)
(2)N,N-di(tallowyl-oxy-ethyl)-N,N-dimethyl ammonium chloride (IV 18)
(3)1,2-ditallowyloxy-3-N,N,N-trimethylammoniopropane chloride
(4)Ditallow dimethyl ammonium chloride
(5)Methyl bis (tallow amidoethyl)-2-hydroxyethyl ammonium methyl sulfate
(6)1-tallowamidoethyl-2-tallowimidazoline
(7)Cationic polyethylene emulsion available from HOECHST Aktiengesellschaft
(8)Cationic polyethylene emulsion available from HOECHST Aktiengesellschaft
(9)Nonionic polyethylene emulsion available from HOECHST Aktiengesellschaft
(10)Sodium diethylenetriamine pentaacetate
(11)Dimethyl-terephthalate, 1,2 propylene glycol, methyl capped PEG polymer

EXAMPLE II

The liquid fabric softening composition of EXAMPLE 1, formula A is prepared as follows:

The fabric softening compound containing ethanol is melted in a water bath at a temperature of from about 70° to about 75° C. to from a molten organic phase. Separately, a dispersible polyethylene emulsion, silicone anti-foaming agent and hydrochloric acid are added to water, covered and heated to a temperature of from about 70° to about 75° C.

The aqueous system is transferred to an insulated baffled mixing vessel which is fitted with a turbine blade impeller. The molten organic phase is slowly added to the aqueous phase under high speed agitation. The dispersion becomes highly viscous. A small portion of the total calcium chloride is slowly added to the dispersion as a 2.5% solution. A small portion of the total chelant, pre-acidified with hydrochloric acid is added to create a very fluid dispersion.

The dispersion is milled using a probe rotor-stator high shear device for a period of time corresponding to batch size. The milled product is chilled in an ice bath to room temperature over a 3–6 minute period. In sequence, phase stabilizer, remaining acidified chelant, perfume, ammonium chloride and remaining calcium chloride are added with vigorous mixing. Dye may then be added as desired. The final product is very fluid with a viscosity of less than 100 centipoise and has a pH of about 3.

EXAMPLE III

The liquid fabric softening composition of EXAMPLE 1, formula B is prepared as follows:

The fabric softening compound containing isopropanol is melted in a water bath at a temperature of from about 75° to about 80° C. to from a molten organic phase. Separately, a dispersible polyethylene emulsion, silicone anti-foaming agent and hydrochloric acid are added to water, covered and heated to a temperature of from about 75° to about 80° C.

The aqueous system is transferred to an insulated baffled mixing vessel which is fitted with a turbine blade impeller. The molten organic phase is slowly added to the aqueous phase under high speed agitation. The dispersion becomes highly viscous. A portion of the total calcium chloride is slowly added to the dispersion as a 25% solution until viscosity is drastically reduced The dispersion is chilled to ambient temperature in an ice bath to over a 3–6 minute period. In sequence, phase stabilizer, perfume, and remaining calcium chloride are added with vigorous mixing. Dye may then be added as desired. The final product is very fluid with a viscosity of less than 100 centipoise and has a pH of about 3.

EXAMPLE IV

The liquid fabric softening composition of EXAMPLE 1, formula C is prepared as follows:

The fabric softening compound containing ethanol is melted in a water bath at a temperature of from about 70° to about 75° C. to from a molten organic phase. Separately, a dispersible polyethylene emulsion, silicone anti-foaming agent and hydrochloric acid are added to water, covered and heated to a temperature of from about 70° to about 75° C.

The aqueous system is transferred to an insulated baffled mixing vessel which is fitted with a turbine blade impeller. The molten organic phase is slowly added to the aqueous phase under high speed agitation. The dispersion becomes highly viscous. A small portion of the total calcium chloride is slowly added to the dispersion as a 25% solution.

The dispersion is milled using a probe rotor-stator high shear device for a period of time corresponding to batch size. The milled product is chilled in an ice bath to room temperature over a 3–6 minute period. In sequence, phase stabilizer, perfume, ammonium chloride and remaining calcium chloride are added with vigorous mixing. Dye may then be added as desired. The final product is very fluid with a viscosity of less than 100 centipoise and has a pH of about 3.

EXAMPLE V

Liquid fabric softening compositions according to the present invention are formulated as follows:

| Ingredient | A Wt. % | B Wt. % |
|---|---|---|
| Fabric Softening Compound(1) | 2.0 | 2.85 |
| Isopropanol | 0.3 | 0.3 |
| VELUSTROL PKS(2) | 85.0 | 62.5 |
| Calcium Chloride | 0.05 | 0.05 |
| Hydrochloric acid | 0.5 | 0.5 |
| Soil Release Agent(3) | 0.2 | 0.2 |
| Silicone Anti-foam | 0.01 | 0.01 |
| Polyethylene glycol 4000 | 0.6 | 0.6 |
| Misc. | 0.7 | 0.7 |
| Water | to 100 | to 100 |

(1)N,N-di(tallowyl-oxy-ethyl)-N,N-dimethyl ammonium chloride (IV 18)
(2)Cationic polyethylene emulsion available from HOECHST Aktiengesellschaft
(3)Dimethyl-terephthalate, 1,2 propylene glycol, methyl capped PEG polymer

EXAMPLE VI

Liquid fabric softening compositions according to the present invention are formulated as follows:

| Ingredient | A Wt. % | B Wt. % | C Wt. % | D Wt. % |
|---|---|---|---|---|
| Fabric Softening Compound(1) | 25.0 | — | — | — |
| Fabric Softening Compound(2) | — | — | — | — |
| Fabric Softening Compound(3) | — | 18.0 | — | — |
| Fabric Softening Compound(4) | — | — | 11.0 | 4.0 |
| Fabric Softening Compound(5) | — | — | 13.5 | — |
| Fabric Softening Compound(6) | — | — | — | 3.4 |
| Ethanol | 4.0 | — | 5.0 | 1.0 |
| Isopropanol | — | 6.0 | — | — |
| VELUSTROL KPA(8) | 5.0 | 1.0 | — | — |
| VELUSTROL P-40(9) | — | — | 2.0 | 6.0 |
| Calcium Chloride | 0.6 | 0.5 | 0.5 | 0.05 |
| Chelant(10) | — | — | — | — |
| Hydrochloric acid | 0.05 | 0.02 | — | 0.2 |
| Soil Release Agent(11) | 0.5 | — | — | — |
| Silicone Anti-foam | 0.01 | — | — | 0.01 |
| Misc. | 1.3 | 1.0 | 1.0 | 0.4 |
| Water | to 100 | to 100 | to 100 | to 100 |

(1)N,N-di(tallowyl-oxy-ethyl)-N,N-dimethyl ammonium chloride (IV 50)
(2)N,N-di(tallowyl-oxy-ethyl)-N,N-dimethyl ammonium chloride (IV 18)
(3)1,2-ditallowyloxy-3-N,N,N-trimethylammoniopropane chloride
(4)Ditallow dimethyl ammonium chloride
(5)Methyl bis (tallow amidoethyl)-2-hydroxyethyl ammonium methyl sulfate
(6)1-tallowamidoethyl-2-tallowimidazoline
(7)Cationic polyethylene emulsion available from HOECHST Aktiengesellschaft
(8)Cationic polyethylene emulsion available from HOECHST Aktiengesellschaft
(9)Nonionic polyethylene emulsion available from HOECHST Aktiengesellschaft
(10)Sodium diethylenetriamine pentaacetate
(11)Dimethyl-terephthalate, 1,2 propylene glycol, methyl capped PEG polymer

What is claimed is:

1. A liquid rinse added fabric softening composition comprising:

(A) from about 0.05% to about 50% by weight of the composition of a cationic quaternary ammonium fabric softening compound or amine precursor thereof;

(B) from about 0.01% to about 50% by weight of the composition of a dispersible polyolefin;

(C) optionally, from about 0% to about 30% by weight of the composition of a dispersibility modifier; and (D) the balance comprising a liquid carrier selected from the group consisting of: water; $C_{1-4}$ monohydric alcohol; $C_{2-6}$ polyhydric alcohol; propylene carbonate; liquid polyethylene glycols; and mixtures thereof;

wherein the level of amphoteric surfactant, if any, is less than about 1% by weight of said composition.

2. The fabric softening composition as claimed in claim 1 wherein said dispersible polyolefin is added as an emulsion or suspension of polyolefin.

3. The fabric softening composition as claimed in claim 2 wherein said dispersible polyolefin is added as an emulsion and said emulsion comprises from about 10 to about 35% by weight of polyolefin.

4. The fabric softening composition as claimed in claim 3 further including an emulsifier in said polyolefin emulsion and wherein the ratio of emulsifier to polyolefin in said polyolefin emulsion is from about 1:10 to about 3:1.

5. The fabric softening composition as claimed in claim 2 wherein said polyolefin emulsion or suspension is a polyethylene emulsion or suspension.

6. The fabric softening composition as claimed in claim 5 wherein said polyethylene is a modified polyethylene.

7. The fabric softening composition as claimed in claim 6 wherein said modified polyethylene is an oxidized polyethylene.

8. The fabric softening composition as claimed in claim 4 wherein said emulsifier is a cationic or nonionic surfactant.

9. The fabric softening composition as claimed in claim 8 wherein said emulsifier is a cationic surfactant.

10. The fabric softening composition as claimed in claim 1 wherein the total active defined as the sum of fabric softening compound or amine precursor thereof and dispersible polyolefin is within the range of from about 1% to about 40% by weight of the composition and the mass ratio of said softening compound to said polyolefin is within the range of from about 75:1 to about 5:1.

11. The fabric softening composition as claimed in claim 1 wherein the total active defined as the sum of fabric softening compound or amine precursor thereof and dispersible polyolefin is within the range of from about 1% to about 40% by weight of the composition and the mass ratio of said softening compound to said polyolefin is within the range of from about 0.05:1 to about 2:1.

12. A liquid rinse added fabric softening composition comprising:

(A) from about 0.05% to about 50% by weight of the composition of a cationic quaternary ammonium fabric softening compound or amine precursor thereof having the formula:

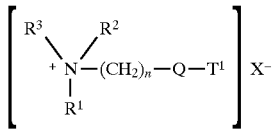

(I)

or

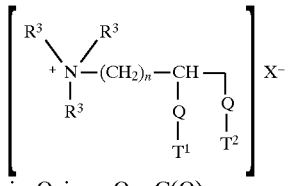

(II)

wherein Q is —O—C(O)— or —C(O)—O— or —O—C(O)—O— or —$NR^4$—C(O)— or —C(O)—$NR^4$—; $R^1$ is $(CH_2)_n$—Q—$T^2$ or $T^3$ or $R^3$; $R^2$ is $(CH_2)_m$—Q—$T^4$ or $T^5$ or $R^3$; $R^3$ is $C_1$–$C_4$ alkyl or $C_1$–$C_4$ hydroxyalkyl or H; $R^4$ is H or $C_1$–$C_4$ alkyl or $C_1$–$C_4$ hydroxyalkyl; $T^1$, $T^2$, $T^3$, $T^4$, $T^5$ are (the same or different) $C_{11}$–$C_{22}$ alkyl or alkenyl; n and m are integers from 1 to 4; and $X^-$ is a softener-compatible anion, the alkyl, or alkenyl, chain $T^1$, $T^2$, $T^3$, $T^4$, $T^5$ must contain at least 11 carbon atoms;

(B) from about 0.01% to about 50% by weight of the composition of a dispersible polyolefin;

(C) optionally, from about 0% to about 30% by weight of the composition of a dispersibility modifier; and (D) the balance comprising a liquid carrier selected from the group consisting of: water; $C_{1-4}$ monohydric alcohol; $C_{2-6}$ polyhydric alcohol; propylene carbonate; liquid polyethylene glycols; and mixtures thereof;

wherein the level of amphoteric surfactant, if any, is less than about 1% by weight of said composition.

13. The fabric softening composition as claimed in claim 12 wherein the quaternary ammonium compound is derived from $C_{12}$–$C_{22}$ fatty acyl groups having an Iodine Value of from greater than about 5 to less than about 100, a cis/trans isomer weight ratio of greater than about 30/70 when the Iodine Value is less than about 25, the level of unsaturation of the fatty acyl groups being less than about 65% by weight.

14. The fabric softening composition as claimed in claim 13 wherein said quaternary ammonium compound is N,N-di(tallowyl-oxy-ethyl)-N,N-dimethyl ammonium chloride.

15. The fabric softening composition as claimed in claim 12 wherein said composition includes a dispersibility modifier selected from the group consisting of: single-long-chain-$C_{10}$–$C_{22}$ alkyl, cationic surfactant; nonionic surfactant with at least 8 ethoxy moieties; amine oxide surfactant; quaternary ammonium salts of the general formula:

$$(R^2N^+R_3)X^-$$

wherein the $R^2$ group is a $C_{10}$–$C_{22}$ hydrocarbon group, or the corresponding ester linkage interrupted group with a short alkylene ($C_1$–$C_4$) group between the ester linkage and the N, and having a similar hydrocarbon group, each R is a $C_1$–$C_4$ alkyl or substituted alkyl, or hydrogen; and the counterion $X^-$ is a softener compatible anion, and mixtures thereof.

16. The fabric softening composition as claimed in claim 12 wherein said dispersible polyolefin is added as an emulsion and said emulsion comprises from about 10 to about 35% by weight of polyolefin.

17. The fabric softening composition as claimed in claim 16 wherein said polyolefin emulsion is a polyethylene emulsion.

18. The fabric softening composition as claimed in claim 17 wherein said polyethylene is an oxidized polyethylene.

19. The fabric softening composition as claimed in claim 12 wherein the total active defined as the sum of fabric softening compound or amine precursor thereof and dispersible polyolefin is within the range of from about 1% to about 40% by weight of the composition and the mass ratio of said softening compound to said polyolefin is within the range of from about 75:1 to about 5:1.

20. The fabric softening composition as claimed in claim 12 wherein the total active defined as the sum of fabric softening compound or amine precursor thereof and dispersible polyolefin is within the range of from about 1% to about 40% by weight of the composition and the mass ratio of said softening compound to said polyolefin is within the range of from about 0.05:1 to about 2:1.

21. The fabric softening composition as claimed in claim 12 wherein the pH of said composition is from about 2 to about 5.

22. A liquid rinse added fabric softening composition comprising:

(A) from about 0.05% to about 50% by weight of the composition of a cationic quaternary ammonium fabric softening compound or amine precursor thereof having the formula (I) or (II), below:

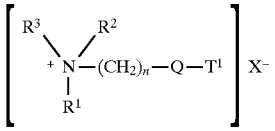

(I)

or

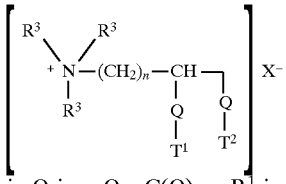

(II)

wherein Q is —O—C(O)—, $R^1$ is $(CH_2)_n$—Q—$T^2$, $R^2$ and $R^3$ are the same or different and are $C_1$–$C_4$ alkyl or $C_1$–$C_4$ hydroxyalkyl or H; $T^1$ and $T^2$ are (the same or different) $C_{11}$–$C_{22}$ alkyl or alkenyl; n and m are integers from 1 to 4; and $X^-$ is a softener-compatible anion;

(B) from about 0.01% to about 50% by weight of the composition of a dispersible polyethylene (C) optionally, from about 0% to about 30% by weight of the composition of a dispersibility modifier; and (D) the balance comprising a liquid carrier selected from the group consisting of: water; $C_{1-4}$ monohydric alcohol; $C_{2-6}$ polyhydric alcohol; propylene carbonate; liquid polyethylene glycols; and mixtures thereof.

23. The fabric softening composition as claimed in claim 22 wherein the biodegradable quaternary ammonium compound is derived from $C_{12}$–$C_{22}$ fatty acyl groups having an Iodine Value of from greater than about 5 to less than about 100, a cis/trans isomer weight ratio of greater than about 30/70 when the Iodine Value is less than about 25, the level of unsaturation of the fatty acyl groups being less than about 65% by weight.

24. The fabric softening composition as claimed in claim 23 wherein said quaternary ammonium compound is N,N-di(tallowyl-oxy-ethyl)-N,N-dimethyl ammonium chloride.

25. The fabric softening composition as claimed in claim 22 wherein said dispersible polyethylene is added as an emulsion comprising from about 10 to about 35% by weight of polyethylene, and an emulsifier.

26. The fabric softening composition as claimed in claim 25 wherein the ratio of emulsifier to polyethylene in said polyethylene emulsion is from about 1:10 to about 3:1.

27. The fabric softening composition as claimed in claim 22 wherein said polyethylene is an oxidized polyethylene.

28. The fabric softening composition as claimed in claim 25 wherein said emulsifier is a cationic or nonionic surfactant.

29. The fabric softening composition as claimed in claim 28 wherein said emulsifier is a cationic surfactant.

30. The fabric softening composition as claimed in claim 22 wherein the pH of said composition is from about 2 to about 5.

31. The fabric softening composition as claimed in claim 22 wherein the total active defined as the sum of fabric softening compound or amine precursor thereof and dispersible polyolefin is within the range of from about 1% to about 40% by weight of the composition and the mass ratio of said softening compound to said polyolefin is within the range of from about 75:1 to about 5:1.

32. The fabric softening composition as claimed in claim 22 wherein the total active defined as the sum of fabric softening compound or amine precursor thereof and dispersible polyolefin is within the range of from about 1% to about 40% by weight of the composition and the mass ratio of said softening compound to said polyolefin is within the range of from about 0.05:1 to about 2:1.

33. A liquid rinse added fabric softening composition comprising:

(A) from about 4% to about 30% by weight of the composition of N,N-di(tallowyl-oxy-ethyl)-N,N-dimethyl ammonium chloride or amine precursor thereof;

(B) from about 0.5% to about 25% by weight of the composition of an cationic emulsion or suspension of oxidized polyethylene;

(C) optionally, from about 0% to about 30% by weight of the composition of a dispersibility modifier; and (D) the balance comprising a liquid carrier selected from the group consisting of: water; $C_{1-4}$ monohydric alcohol; $C_{2-6}$ polyhydric alcohol; propylene carbonate; liquid polyethylene glycols; and mixtures thereof.

34. A method for laundering fabrics comprising contacting said fabrics in the rinse cycle with an aqueous medium containing at least 50 ppm of a laundry composition of a fabric softening composition according to claim 22.

35. A method for laundering fabrics comprising contacting said fabrics in the rinse cycle with an aqueous medium containing at least 50 ppm of a laundry composition of a fabric softening composition according to claim 22.

36. A method for laundering fabrics comprising contacting said fabrics in the cycle with an aqueous medium containing at least 50 ppm of a laundry composition of a fabric softening composition according to claim 33.

* * * * *